US006497922B2

(12) United States Patent
Knight et al.

(10) Patent No.: US 6,497,922 B2
(45) Date of Patent: Dec. 24, 2002

(54) METHOD OF APPLYING CORROSION, OXIDATION AND/OR WEAR-RESISTANT COATINGS

(75) Inventors: Richard Knight, Philadelphia, PA (US); Michel W. Barsoum, Pennsauken, NJ (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 09/854,820

(22) Filed: May 14, 2001

(65) Prior Publication Data

US 2001/0026845 A1 Oct. 4, 2001

Related U.S. Application Data

(62) Division of application No. 09/131,101, filed on Aug. 7, 1998, now Pat. No. 6,231,969.

(60) Provisional application No. 60/055,194, filed on Aug. 11, 1997.

(51) Int. Cl.[7] ..... C23C 4/10

(52) U.S. Cl. ..... 427/450; 427/445; 427/451; 427/452

(58) Field of Search ..... 427/450, 451, 427/452, 446

(56) References Cited

U.S. PATENT DOCUMENTS

| | | | | |
|---|---|---|---|---|
| 4,694,990 A | | 9/1987 | Karlsson et al. | |
| 4,961,529 A | * | 10/1990 | Gottselig et al. | 228/124 |
| 5,182,238 A | | 1/1993 | Holleck | |
| 5,207,382 A | | 5/1993 | Simm et al. | |
| 5,223,332 A | | 6/1993 | Quets | |
| 5,271,965 A | | 12/1993 | Browning | |
| 5,384,164 A | | 1/1995 | Browning | |
| 5,451,470 A | | 9/1995 | Ashary et al. | |
| 5,934,900 A | * | 8/1999 | Billings | 432/264 |

FOREIGN PATENT DOCUMENTS

| | | |
|---|---|---|
| WO | WO97/18162 A1 | 5/1997 |
| WO | WO97/27965 A1 | 8/1997 |
| WO | WO98/22244 A1 | 5/1998 |

OTHER PUBLICATIONS

Smith, et al, "High Velocity Oxy–Fuel Spray Wear Resistant Coatings of TiC Composite Powders", in Thermal Spray Research and Applications, Proceedings of the Third National Thermal Spray Conference, Long Beach, CA, May 1990, pp. 617–623.*

Kreye, H., et al., "Microstructure and Bond Strength of WC–Co Coatings Deposited by Hypersonic Flame Spraying (Jet Kote Process)," *Advances in Thermal Spraying*, pp. 121–128 (Sep. 1986).

McGinn, P., et al., "Coatings of $YBa_2Cu_3O_{6\#x}$ Thermal Sprayed Using the Jet Kote™*Process*," *Surface and Coatings Technology*, 37: 359–368 (1989). (no month date).

Parker, D., et al., "HVOF–Spray Technology–Posied for Growth," *Advanced Materials & Processes*, 6 pages (Apr. 1991).

Irving, B., et al., "The HVOF Process: The Hottest Topic in the Thermal Spray Industry," *Welding Journal*, 72(7): 25–30 (Jul. 1993).

Pampuch, R., et al., "$Ti_3SiC_2$–Based Materials Produced by Self–Propagating High–Temperature Synthesis (SHS) and Ceramic Processing," *Journal of Materials Synthesis and Processing*, 1(2): 93–100 (1993). (no month date).

* cited by examiner

*Primary Examiner*—Katherine A. Bareford
(74) *Attorney, Agent, or Firm*—Akin Gump Strauss Hauer & Feld, L.L.P.

(57) ABSTRACT

Corrosion-resistant, oxidation-resistant, and/or wear-resistant coatings are made of ternary ceramic compounds of the general formula (I):

$$M_2X_1Z_1 \quad \text{(I)}$$

wherein M is at least one transition metal, X is an element selected from the group consisting of Si, Al, Ge, Pb, Sn, Ga, P, S, In, As, Tl and Cd, and Z is a non-metal selected from the group consisting of carbon and nitrogen; and/or compounds of the general formula (II):

$$M_3X_1Z_2 \quad \text{(II)}$$

wherein M is at least one transition metal, X is at least one of Al, Ge, and Si, and Z is at least one of carbon and nitrogen. Such coatings may be applied by a thermal spraying process.

8 Claims, No Drawings

METHOD OF APPLYING CORROSION, OXIDATION AND/OR WEAR-RESISTANT COATINGS

CROSS-REFERENCE TO RELATED APPLICATIONS

This application is a division of U.S. patent application Ser. No. 09/131,101, filed Aug. 7, 1998, now U.S. Pat. No. 6,231,969, which claimed benefit of provisional U.S. Patent Application No. 60/055,194, filed Aug. 11, 1997.

BACKGROUND OF THE INVENTION

Ceramics are a general class of compounds that are the product of treating earthy raw materials with heat. Many ceramics comprise silicon and its oxides. Some of the more common ceramics are clay products, such as brick, porcelain, glass, and alumina. Ceramics are known for their heat-resistance, hardness, and strength. Metals, which are easily machined, do not retain their machined form at high temperatures. Ceramics, however, retain their shape at extremely high temperatures, but are brittle and very difficult to machine into a desired shape. Materials engineers have directed a great deal of effort into finding compositions that are easily machined into a desired shape and are stable at extremely high temperatures.

Ternary ceramic compounds such as titanium silicon carbide ($Ti_3SiC_2$), and related "3-1-2" phase ceramics, as well as the "H-phase" ceramics have been studied and identified as meeting these requirements; that is, they are easily machineable and heat-resistant. For these reasons ternary ceramic compounds have been used to construct workpieces of varied shapes having heat-resistant properties and high strength. International Patent Application WO98/22244, published on May 28, 1998, of Barsoum et al. for "Process for Making a Dense Ceramic Workpiece" describes a process for making workpieces from these types of ceramic compounds and is herein incorporated by reference.

The application of corrosion resistant coatings to different articles in order to protect their surfaces from degradation by oxidation or chemical attack is a vastly important field of study. Much effort has been devoted to extending the useful lives of articles subject to corrosion by coating the article with a corrosion resistant composition. Coatings are also applied to substrates for protection against wear. Coatings with corrosion-resistant and wear-resistant properties are applied in many different ways. Some are applied by dipping or painting, others are applied by chemical adsorption, and still others are applied by chemical reaction. Many coatings used to provide protection to surfaces are applied by thermal spraying processes.

Thermal spray processes are a well known family of coating technologies that include detonation guns, high-velocity oxyfuel spray processes, wire-arc spraying, and both air and vacuum plasma spraying. U.S. Pat. No. 5,451,470 of Ashary et al.; U.S. Pat. No. 5,384,164 of Browning; U.S. Pat. No. 5,271,965 of Browning; U.S. Pat. No. 5,223,332 of Quets; U.S. Pat. No. 5,207,382 of Simm et al.; and U.S. Pat. No. 4,694,990 of Karlsson et al., collectively describe thermal spray processes and are herein incorporated by reference.

The types of coatings applied by these thermal spray techniques have generally been grouped into two broad categories, carbides and non-carbides. The carbides applied by thermal spray processes are generally transition-metal carbides such as tungsten carbide, chromium carbide, and cobalt-based carbides. The non-carbides applied by thermal spraying processes include iron-nickel based alloys, copper-nickel-indium alloys, metals and alloys such as aluminum, zinc, steel, bronze, and nickel, and aluminum-polyesters. Some ceramics, such as alumina and titania, which offer good wear-resistance, can be applied as coatings using the extremely high temperature (usually greater than 11,000° C.) plasma spraying technique. Yttria-stabilized zirconia (YSZ), another ceramic, is well known as a thermal barrier coating in applications subject to extremely high temperatures.

High-velocity oxyfuel spray processes are advantageous in that they provide excellent dense, adherent coatings. Also the equipment used is more portable than other thermal spray equipment. Unfortunately, the ternary ceramic compounds described above have dissociation temperatures in the general range of from about 1000° C. to about 1800° C., and most thermal spray processes, including high-velocity oxyfuel, have gas jet temperatures in excess of 2500° C.

BRIEF SUMMARY OF THE INVENTION

It has been both unexpectedly and surprisingly found, however, that the ternary ceramic compounds in accordance with the present invention can be sprayed using thermal spray processes to form adherent, corrosion-resistant, oxidation-resistant and/or wear-resistant coatings, and that the composition of the compounds remains substantially unchanged after undergoing the thermal spray process.

According to the present invention, articles are produced having a surface with a coating having corrosion-resistant, oxidation-resistant and/or wear-resistant properties, the coating comprising at least one of a ceramic compound of the general formula (I):

$$M_2X_1Z_1 \quad \text{(I)}$$

wherein M is at least one transition metal, X is an element selected from the group consisting of Si, Al, Ge, Pb, Sn, Ga, P, S, In, As, Tl and Cd, and Z is a non-metal selected from the group consisting of carbon and nitrogen; and a ceramic compound of the general formula (II):

$$M_3X_1Z_2 \quad \text{(II)}$$

wherein M is at least one transition metal, X is at least one of Al, Ge, and Si, and Z is at least one of carbon and nitrogen.

In accordance with the present invention, it is desirable that the coating be substantially comprised of the ceramic compounds of the general formulas (I) and/or (II), by minimizing the dissociation of the ceramic compounds during application. The ternary ceramic compounds of the general formulas (I) and/or (II) are present in the coatings of the present invention in an amount of at least about 70% by volume of the ternary ceramic compounds sprayed. Preferably, the ternary ceramic compounds of the general formulas (I) and (II) are present in the coatings of the present invention in an amount of at least about 80% by volume of the ternary ceramic compounds sprayed, and more preferably they are present in the coatings of the present invention in an amount of at least about 90% by volume of the ternary ceramic compounds sprayed.

Also, according to the present invention, articles are produced having a surface with a coating having corrosion-resistant, oxidation-resistant and/or wear-resistant properties, the coating being produced by a process comprising the steps of providing a powder of at least one of a ceramic compound of the general formula (I) as described above, and a ceramic compound of the general formula (II) as described above; and thermal spraying the powder of the at least one compound onto the surface. It is preferable that the coating is substantially comprised of the ceramic compounds of the general formulas (I) and/or (II) and the presence of dissociation products of the ceramic compounds is minimized. The minimization of dissociation of the ceramic powder particles is accomplished by controlling both the temperature of the thermal spraying device, and the length of time which the ceramic powder particles remain within the thermal spraying device, during which they are being heated.

According to another aspect of the present invention, a method is provided for coating a surface comprising the steps of providing a powder of at least one of a ceramic compound of the general formula (I) as described above, and a ceramic compound of the general formula (II) as described above; and thermal spraying the powder of the at least one compound onto the surface, whereby a coating having corrosion resistant, oxidation resistant and/or wear resistant properties results on the surface, the coating substantially comprised of ceramic compounds of the general formulas (I) and/or (II).

In a preferred embodiment of the present invention the coating is comprised of titanium silicon carbide, $Ti_3SiC_2$, and the thermal spray process utilized is a high-velocity oxyfuel spraying process. The preferred coatings in accordance with the present invention have thickness of at least about 0.002 inches, and more preferably at least about 0.005 inches.

DETAILED DESCRIPTION OF THE INVENTION

Ceramic powders of the general formula (I) are known synonymously both as "H-phase" and "2-1-1" ceramics, signifying the molar ratio of component M to component X to component Z, or M:X:Z. Ceramics of this type and their syntheses are disclosed and described in detail in International Patent Application WO97/27965, published on Aug. 7, 1997, of Barsoum et al. for "Synthesis of H-phase Products", and its disclosures are herein incorporated by reference.

Ceramic powders of the general formula (II) are known as "3-1-2" ceramics, signifying the molar ratio of component M to component X to component Z, or M:X:Z. Ceramics of this type and their syntheses are disclosed and described in detail in International Patent Application WO97/18162, published on May 22, 1997, of Barsoum et al. for "Synthesis of 312 Phases and Composites Thereof", and its disclosures are herein incorporated by reference.

The ceramics used in the present invention can be powdered in a conventional manner, for example, by mechanical crushing. The powders used in the present invention should have a maximum particle size of about 100 $\mu$m, and a minimum particle size of about 5 $\mu$m. In a more preferred embodiment of the present invention, the powders have a maximum particle size of about 65 $\mu$m, and a minimum particle size of about 7 $\mu$m, and in a most preferred embodiment, the powders have a maximum particle size of about 45 $\mu$m, and a minimum particle size of about 10 $\mu$m. Particle size determination can be accomplished by any conventional method, such as for example, mesh screening or laser scattering.

The preferred ceramic compounds to be used in accordance with the present invention are those corresponding to general formula (II), the "3-1-2" phase ceramics. The most preferred ceramic is titanium silicon carbide, $Ti_3SiC_2$.

The coating comprising a ceramic as described above should have a thickness of at least about 0.002 inches, preferably at least about 0.005 inches, and more preferably at least about 0.008 inches. The thickness of the coating should be such that complete coverage of the surface is obtained. Coverage that is not complete, or near complete can hinder the corrosion-resistant properties of the coating. Additionally, the above mentioned approximate minimum coating thickness is necessary to maintain the integrity or cohesion of the coating. The approximate maximum thickness of the coating may be determined by the intended end use of the article being coated, although the approximate maximum thickness of the coating should not be so great that residual stresses in the coating itself impair its properties. The possibility that contraction of the ceramic coating upon cooling will create cracks in the coating increases as the outer surface of the coating moves farther and farther away from the surface being coated.

The coatings in accordance with the present invention have limited porosity. The porosity of the coatings is approximately 30% or less.

Additional materials or powders can be further mixed with the ternary ceramic powders being sprayed onto a surface in accordance with the present invention. Examples of such additional materials and powders are carbides, silicides, nitrides, oxides, other thermally sprayable compounds, and mixtures thereof.

The coatings in accordance with the present invention are useful for providing corrosion-resistance and/or wear-resistance to the surfaces of articles, both metal and non-metal (e.g., other ceramics), such as those used in the manufacture of chemical plant equipment including without limitation, pressure vessels, reactors, storage tanks, pipe lines, valves, heat exchangers, and the like.

In accordance with the present invention, a coating comprising a ceramic as described above can be applied to the surface of an article by a thermal spray process. The method of coating a surface with a coating comprised of a ceramic, as described above, involves the heating of a stream of ceramic particles and accelerating the particles through a nozzle, aimed at the surface to be coated. Upon impact the heated particles impact against the surface, spreading out and adhering to the surface. By using a thermal spray process, a dense, thick, contiguous coating of ceramic can be obtained according to the present invention. Thermal spraying techniques of other materials have been used to apply coatings to various substrates, and these thermal spraying processes may be adapted to the application of the coatings of the present invention to substrates on which a corrosion-resistant, oxidation-resistant and/or wear-resistant coating is desired.

The temperature of the gas jet exiting a thermal spray gun is usually in excess of at least about 2000° C., and more usually in excess of 2500° C. The dissociation temperatures of the ceramic compounds used in accordance with the present invention are between about 1000° C. and about 1800° C. In accordance with the present invention, it is therefor desirable to optimize the residence time of the powder particles inside the spray gun. The residence time, the time spent by the powder particle from the moment it enters the jet of heated gas to the moment it exits the jet, must be controlled in conjunction with the gas jet temperature to minimize the dissociation of the ceramic compound. The higher the gas jet temperature, the faster the particles must exit the spray gun. Conversely, the lower the gas jet temperature, the less quickly the particles must exit the spray gun. It is necessary to control the residence time and the temperature of the thermal spray jet so that the ceramic particles are at least partly softened or near their dissociation temperature so that they will adhere to the surface and to each other on impact, but also so that the ceramic does not appreciably dissociate. Some dissociation of the ceramic is not necessarily harmful, particularly where the dissociation products are other wear-resistant ceramics such as titanium carbide. However, it is preferred that the ternary ceramics of the invention be maintained to the greatest extent possible.

Thermal spray processes that can be used to apply a coating in accordance with the present invention include, but are not limited to detonation gun techniques, both air and vacuum plasma spraying, high-velocity oxyfuel spray processes, wire arc spraying, conventional flame spraying and the like. The preferred thermal spray process to be used in accordance with the present invention is a high-velocity oxyfuel spray process, although any thermal spray process could be used. High-velocity oxyfuel processes involve the feeding of a gaseous fuel, oxygen and a coating powder into a spray gun. Inside of the gun the fuel is combusted, usually with oxygen although in some guns air is used, and the powder is fed into the path of the combusted fuel exiting through the nozzle of the gun. Particle velocity, which determines the residence time or dwell time of the particles, is a function of the combustion process gases and their flow rate, which is typically on the order of 1500 scfh (standard cubic feet per hour). The fuel used in high-velocity oxyfuel spraying processes can be a gas or liquid fuel. Gases commonly used are, for example, hydrogen, propylene, propane, and acetylene. An example of a liquid fuel used is kerosene.

The specific parameters used in the high-velocity oxyfuel spray process can vary. The distance from the nozzle tip to the surface being coated, the flow rates of the fuel and oxygen gases, and the horizontal speed of the spray gun relative to the part being coated are some examples of the parameters which can be varied in applying a coating in accordance with the present invention. When applying a coating of a ceramic compound in accordance with the present invention the spray distance, the distance from the exit of the gun nozzle to the surface being coated, should be from about 5 inches to about 10 inches, preferably from about 6 inches to about 9 inches, and more preferably from about 7 inches to about 8 inches. The horizontal traverse speed of the spray gun, the speed at which the stream of molten, or nearly molten, particles exiting the gun nozzle, moves across the surface of the article being coated should be from about zero feet per minute to about 100 feet per minute, preferably from about 1 foot per minute to about 50 feet per minute, and more preferably from about 2 feet per minute to about 40 feet per minute.

The gas used as the combustion fuel in a high velocity oxyfuel spray process can vary, but is usually hydrogen. The rate at which the oxygen is fed into the spray gun can be from about 400 standard cubic feet per hour (SCFH) to about 600 SCFH. The rate at which oxygen is fed into the spray gun is preferably from about 450 SCFH to about 550 SCFH, and more preferably about 500 SCFH. The rate at which hydrogen is fed into the spray gun can be from about 1000 SCFH to about 1800 SCFH. The rate at which hydrogen is fed into the spray gun is preferably from about 1050 SCFH to about 1250 SCFH, and more preferably from about 1100 SCFH to about 1200 SCFH. These rates can be adjusted accordingly for other common fuel gases used in high-velocity oxyfuel processes, such as propylene or acetylene, as is known in the art.

Other variables of concern with respect to the thermal spray process are the powder feed rate, the nozzle size, number of passes across the surface, and whether or not the surface is preheated. When the present invention is practiced using a high velocity oxyfuel spray process, the powder feed rate can be from about 5 grams per minute (g/m) to about 100 grams per minute (g/m). The powder feed rate is preferably from about 10 grams per minute (g/m) to about 80 grams per minute (g/m), and more preferably from about 20 grams per minute (g/m) to about 50 grams per minute (g/m).

The nozzle used in the high-velocity oxyfuel process in accordance with the present invention may be any normal spray nozzle used for such processes. A nozzle with an inner diameter of one quarter of an inch and a length of six to nine inches can be used, as is common in high-velocity oxyfuel spray processes. It should be understood that any conventional nozzle useful for high-velocity oxyfuel spray processes could be used.

The number of passes of the gun across the surface being coated can vary greatly. The number however, is proportional to the desired thickness of the coating. The gun may be passed across the surface as little as once and as many as 50 times, though preferably between 10 and 25 passes.

The surface being coated may also be preheated, for example, by passing the flame exiting the spray gun over the surface without having turned on the powder feed, or by other heating methods. By heating the surface just prior to applying the heated ceramic particles, the amount of stress on the resulting coating, that is caused by the contraction of the coating upon cooling, can be decreased. The surface may be preheated to whatever extent desired, though no preheating at all is required. The surface being coated and the ceramic compound being applied as a coating will often have different coefficients of thermal expansion. Based on the coefficients of thermal expansion for both the surface material and the coating ceramic, the surface can be preheated such that upon cooling, both the surface material and the ceramic contract equally, thereby minimizing stress on the coating. Other forms of pretreatment of the surface to be coated include gritblasting, sanding, and other mechanical or chemical roughening methods to improve adhesion of the coating to the surface.

The method of the present invention is useful for providing corrosion-resistant and/or wear-resistant coatings to the surfaces of metal and/or non-metal articles. The corrosion resistance of substrates coated with $Ti_3SiC_2$ coatings is anticipated to be excellent in view of the preliminary corrosion results obtained from steel coupons coated with $Ti_3SiC_2$ in accordance with the present invention and evaluated with various corrosive materials, as shown in Table I below:

TABLE I

| Corrosive Agent | Temperature (° C.) | Time (Hrs.) | Weight Loss (grams) |
|---|---|---|---|
| 25% $H_2SO_4$ | 20 | 72 | −0.0136 |
| 25% $H_2SO_4$ | 20 | 96 | −0.0150 |
| 25% $H_2SO_4$ | 20 | 168 | −0.0129 |
| 25% $H_2SO_4$ | 20 | 240 | −0.0296 |
| 25% $H_2SO_4$ | 20 | 408 | −0.0346 |
| $H_2SO_4$ (conc.) | 20 | 72 | −0.0622 |
| $H_2SO_4$ (conc.) | 20 | 168 | −0.0655 |
| $H_2SO_4$ (conc.) | 20 | 240 | −0.0776 |
| $H_2SO_4$ (conc.) | 20 | 408 | −0.0809 |
| 25% HCl | 20 | 168 | 0.0039 |
| 25% HCl | 20 | 432 | 0.0048 |

TABLE I-continued

| Corrosive Agent | Temperature (° C.) | Time (Hrs.) | Weight Loss (grams) |
|---|---|---|---|
| 25% HCl | 20 | 624 | 0.0066 |
| 25% HCl | 20 | 768 | 0.0067 |
| 25% HCl | 20 | 936 | 0.0074 |
| HCl (conc.) | 20 | 72 | 0.0038 |
| HCl (conc.) | 20 | 168 | 0.0047 |
| HCl (conc.) | 20 | 240 | 0.0050 |
| HCl (conc.) | 20 | 408 | 0.0060 |
| 25% $HNO_3$ | 20 | 72 | 0.1548 |
| 25% $HNO_3$ | 20 | 168 | 0.2178 |
| 25% $HNO_3$ | 20 | 408 | 0.2792 |
| $HNO_3$ (conc.) | 20 | 72 | 0.0207 |
| $HNO_3$ (conc.) | 20 | 168 | 0.0009 |
| $HNO_3$ (conc.) | 20 | 408 | −0.0097 |

Negative weight loss measurements in Table I indicate a weight gain. As can be seen from Table I, most corrosive agents have a minimal effect on the ceramic blocks. In some cases, as with sulfuric acid (both concentrated and dilute), there is evidence (i.e. weight gain) of the formation of a passive coating on top of the ceramic, providing enhanced resistance to corrosion. Some corrosive agents, such as dilute nitric acid, appear to have more of an effect on the ceramic blocks than others, although all results indicate, at most, minimal weight loss over long periods of time.

The invention will now be illustrated in more detail with reference to the following specific, non-limiting examples. The particular size and material of the surface being coated is not critical in any of the following examples.

EXAMPLE 1

A thermally sprayed coating of a ternary ceramic compound was applied to a 1018 mild steel coupon having dimensions of 1 inch by 3 inches by 0.125 inches thick. The steel coupon was sprayed with powdered titanium silicon carbide, $Ti_3SiC_2$, having a maximum particle size no greater than 63 $\mu$m, using a high-velocity oxyfuel spray gun operating under the following parameters:

Powder Feed Rate: 25 grams/min.

Spray Distance: ~7 inches $O_2$ Gas Flow Rate: ~500 SCFH.

$H_2$ Gas Flow Rate: ~1100 SCFH.

Horizontal Traverse Speed: 20 ft./min.

Spray passes: 8

Preheating: None

The coating applied in the above manner had a thickness of approximately 0.006 inches.

Micrographic examination of the cross sections of the steel coupon produced according to Example 1 showed a coating of relatively uniform thickness which exhibited excellent bonding between the steel surface and the coating. Additionally, x-ray diffraction analysis of the unsprayed ceramic coating particles and the coating applied to the steel coupon according to Example 1 showed that the $Ti_3SiC_2$ was substantially unchanged in its composition when it underwent thermal spraying to form a consolidated coating. The peaks present in the x-ray diffraction spectrum of the uncoated particles were compared with the peaks present in the x-ray diffraction spectrum of the coating. The presence of the same peaks at roughly the same intensities and roughly the same position indicates the lack of substantial change in the ceramic compositions.

EXAMPLE 2

A second 1018 mild steel coupon was sprayed with powdered titanium silicon carbide, $Ti_3SiC_2$, having a maximum particle size no greater than 65 $\mu$m and no smaller than 7 $\mu$m, using a high-velocity oxyfuel spray gun operating under the following parameters:

Powder Feed Rate: 25 grams/min.

Spray Distance: ~9 inches $O_2$ Gas Flow Rate: ~500 SCFH $H_2$ Gas Flow Rate: ~1050 SCFH Horizontal Traverse Speed: 20 ft./min.

Spray passes: 12

Preheating: 2 passes with spray gun without powder feed turned on to heat the surface to be coated to about 150° C.

Pretreatment: Grit blasted using #12 alumina grit

The coating applied in the above manner had a thickness of approximately 0.010 inches.

EXAMPLE 3

A third 1018 mild steel coupon was sprayed with powdered titanium silicon carbide, $Ti_3SiC_2$, having an maximum particle size no greater than 63 $\mu$m and minimum particle size no smaller than 7 $\mu$m, using a high-velocity oxyfuel spray gun operating under the following parameters:

Nozzle: 9 inches long

Powder Feed Rate: 25 grams/min.

Spray Distance: ~8 inches $O_2$ Gas Flow Rate: ~500 SCFH $H_2$ Gas Flow Rate: ~1200 SCFH Horizontal Traverse Speed: 2 ft./min.

Spray passes: 10–20

Preheating: 4–5 passes with spray gun without powder feed turned on to heat the surface to be coated to from about 100° C. to about 200° C.

Pretreatment: Grit blasted using #12 alumina grit

The coating applied in the above manner had a thickness of approximately 0.0115 inches.

EXAMPLE 4

A fourth 1018 mild steel coupon was sprayed with powdered titanium silicon carbide, $Ti_3SiC_2$, having an maximum particle size no greater than 45 $\mu$m, using an air plasma spray gun operating under the following parameters:

Powder Feed Rate: 25 grams/min.

Arc Current/Voltage: ~1050 amps/~50 volts

Spray Distance: ~4 inches

Plasma-Forming Gas: argon/hydrogen

Ar Gas Flow Rate: ~195 SCFH $H_2$ Gas Flow Rate: ~12.5 SCFH

Horizontal Traverse Speed: 15 ft./min.

Spray passes: 3

Preheating: None

Pretreatment: None

The coating applied in the above manner had a thickness of approximately 0.010 inches.

Using x-ray diffraction analysis, some decomposition of the coating particles in the coating of Example 4 was found. The decomposition was most likely due to the higher temperatures associated with the plasma spray process used.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of coating a surface comprising the steps of:

(a) providing a powder of at least one of a ceramic compound of the general formula (I):

$$M_2X_1Z_1 \quad (I)$$

wherein M is at least one transition metal, X is an element selected from the group consisting of Si, Al, Ge, Pb, Sn, Ga, P, S, In, As, Tl and Cd, and Z is a non-metal selected from the group consisting of carbon and nitrogen; and a ceramic compound of the general formula (II):

$$M_3X_1Z_2 \quad (II)$$

wherein M is at least one transition metal, X is at least one of Al, Ge, and Si, and Z is at least one of carbon and nitrogen;

(b) roughening the surface; and (c) thermal spraying the powder of the at least one compound onto the surface;

whereby a coating having at least one of corrosion-resistant, oxidation-resistant or wear-resistant properties, results on the surface.

2. The method according to claim 1, wherein the dissociation of the ceramic compound during the thermal spraying step is minimized by controlling the residence time of the powder particles within the thermal spray and the temperature of the spay.

3. The method according to claim 1, wherein the powder has a maximum particle size of about 100 $\mu$m, and a minimum particle size of about 5 $\mu$m.

4. The method according to claim 1, wherein the powder is $Ti_3SiC_2$.

5. The method according to claim 1, further comprising a step of preheating the surface prior to the thermal spraying step.

6. The method according to claim 1, wherein the thermal spraying step comprises a high-velocity oxyfuel spraying process.

7. The method according to claim 6, wherein the high-velocity oxyfuel spraying process is conducted at a spray distance of from about 5 inches to about 10 inches, a horizontal traverse speed of up to about 25 feet per minute, a powder feed rate of from about 5 grams per minute to about 100 grams per minute, an oxygen flow rate of from about 400 standard cubic feet per hour to about 600 standard cubic feet per hour, and a hydrogen flow rate of from about 1100 standard cubic feet per hour to about 1800 standard cubic feet per hour.

8. The method according to claim 6, wherein the dissociation of the ceramic compound during the thermal spraying step is minimized by controlling the residence time of the powder particles within the thermal spray and the temperature of the spray.

* * * * *